US008167564B2

(12) United States Patent
Streng et al.

(10) Patent No.: US 8,167,564 B2
(45) Date of Patent: May 1, 2012

(54) FAN BLADE

(75) Inventors: Gunter Streng, Schrozberg (DE); Rainer Müller, Zweiflingen-pfahlbach (DE); Rolf Bickel, Igersheim (DE)

(73) Assignee: ebm-papst Mulfingen GmbH & Co. KG, Mulfingen (DE)

( * ) Notice: Subject to any disclaimer, the term of this patent is extended or adjusted under 35 U.S.C. 154(b) by 586 days.

(21) Appl. No.: 12/375,834

(22) PCT Filed: Aug. 1, 2007

(86) PCT No.: PCT/EP2007/057963

§ 371 (c)(1),
(2), (4) Date: Jan. 30, 2009

(87) PCT Pub. No.: WO2008/015233

PCT Pub. Date: Feb. 7, 2008

(65) Prior Publication Data

US 2009/0324413 A1 Dec. 31, 2009

(30) Foreign Application Priority Data

Aug. 3, 2006 (DE) ..... 20 2006 011 898 U

(51) Int. Cl.
*B64C 11/04* (2006.01)
*F04D 29/34* (2006.01)

(52) U.S. Cl. ..... 416/210 R; 416/204 R

(58) Field of Classification Search ..... 416/210 R, 416/219 R, 241 R, 214 R, 223 R, 204 R, 416/235

See application file for complete search history.

(56) References Cited

U.S. PATENT DOCUMENTS

| | | | | |
|---|---|---|---|---|
| 4,636,142 | A | 1/1987 | Baranski | |
| 4,746,271 | A * | 5/1988 | Wright | 416/132 A |
| 5,655,882 | A * | 8/1997 | Morgan et al. | 416/204 R |
| 6,027,310 | A | 2/2000 | Kerr, Jr. et al. | |
| 6,692,233 | B2 * | 2/2004 | Liang | 416/221 |
| 2003/0185684 | A1 | 10/2003 | Zhong | |
| 2003/0231960 | A1 | 12/2003 | Asada et al. | |

FOREIGN PATENT DOCUMENTS

| | | |
|---|---|---|
| GB | 1165738 | 10/1969 |

* cited by examiner

*Primary Examiner* — Thomas L Dickey
*Assistant Examiner* — Nikolay Yushin
(74) *Attorney, Agent, or Firm* — Brinks Hofer Gilson & Lione

(57) ABSTRACT

The present invention relates to a fan blade for axial fans with a blade body comprising an inner inlaid part and an outer blade shaped part partially enclosing said inner inlaid part. The outer blade is made of a material of lower rigidity than the inlaid part. The inlaid part is constructed as a substantially flat metal part adapted to the shape of the blade body and in the fan blade base region has an unencapsulated smooth fixing section.

15 Claims, 3 Drawing Sheets

FAN BLADE

CROSS REFERENCE TO RELATED APPLICATION

This application claims priority to PCT/EP2007/057963 filed Aug. 1, 2007 and DE 20 2006 011 898.5 filed Aug. 3, 2006, the entire contents of which are incorporated herein by reference.

FIELD

The present invention relates to a fan blade for an axial fan with a blade body consisting of an inner inlaid part and an outer blade shaped part that partially encases said inner inlaid part and is made of a material that is weaker or of lower rigidity than the inlaid part.

BACKGROUND

In European Patent Application No. 1 571 346 A2, a fan blade is described where the inlaid part consists of two plate-shaped individual parts arranged perpendicularly to each other. As a result of this arrangement of the inlaid part, the blade body must be relatively thick in order to completely enclose the inlaid part. This gives rise to higher material costs and increases the centrifugal force of the rotating blade wheel, leading to increased loading of forces. In addition, the manufacture and preassembly of the two plate-shaped individual parts are costly. A need therefore exists for the development of fan blades that can be manufactured and assembled at lower costs and that reduce the magnitude of the forces encountered during operation.

SUMMARY

The present invention is based on the objective of providing a fan blade that allows inexpensive manufacture and assembly, on the one hand, and is subject, almost in the shank longitudinal direction on rotation, to substantially no material lengthening.

According to one embodiment of the invention, this objective can be achieved when the inlaid part is embodied as a planar metal part adapted substantially to the shape of the blade body and has in the fan blade base region, an uncoated or unencapsulated flat fastening portion. According to the teachings of the invention, the blade shaped part may be embodied as a plastics material injection-molded part. The fastening portion does not protrude relative to the outer fan blade contour; on the contrary, the fastening portion is integrated in the blade contour. The flat, planar embodiment of the fastening portion facilitates easy assembly of the fan blade with simultaneous orientation. As a result of this configuration, a large proportion of the fan blade wheel resides in its interior of the inlaid part itself, which can be relatively thin in its embodiment; for example, it can be made of a 2 mm-thick steel sheet or of aluminum sheet. The plastics material sheathing is in this case such that a covering of the inlaid part is attained, although the plastics material volume can be kept low. Preferably, the fastening portion is arranged more or less centrally in the fan blade base region and extends directly from the edge of the base region into the blade shaped part. This allows for a very uniform introduction of force into the fan blade wheel and the drive and centrifugal forces are accommodated directly by the inlaid part. As a result the plastics material blade shaped part is relieved in terms of force, so that said blade shaped part is not lengthened during operation.

Another objective of the present invention further relates to a fan wheel that uses the fan blade in accordance with the teachings of the invention.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

Figure 1:
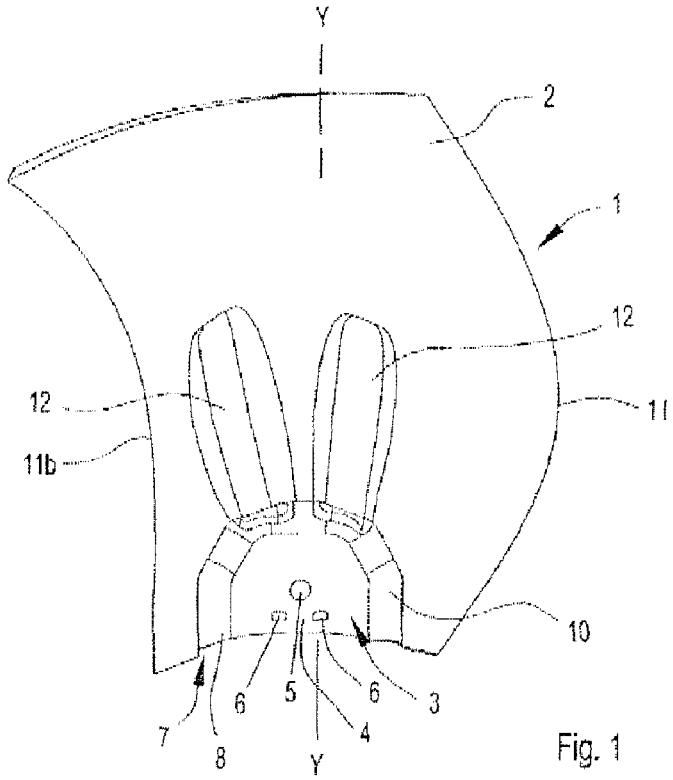
FIG. 1 is a perspective view of a fan blade according to one embodiment of the present invention.

The following description is merely exemplary in nature and is in no way intended to limit the present invention or its application or uses. It should be understood that throughout the description and drawings, corresponding reference numerals indicate like or corresponding parts and features.

A fan blade according to the invention comprises a blade body 1, which is formed from an inlaid part 3, and an outer blade shaped part 2 that partially encases said inlaid part. The outer blade shaped part 2 may be made of a material that can be classified as being less strong, weaker, or of lower rigidity than the inlaid part 3. The inlaid part 3 is embedded in the blade shaped part 2 and completely enclosed apart from its uncoated or unencapsulated fastening portion 4. The blade shaped part 2 is preferably manufactured as a plastics material with the inlaid part 3 being simultaneously sheathed during the process of insert molding or spraying the plastics material part. The plastics material used is preferably one selected from the group of a polyamide plastics material, polypropylene, and polybutylene terephthalate (PBT). According to one aspect of the invention, it can be expedient if the inlaid part 3 is provided with a primer layer as an adhesion promoter prior to the sheathing.

Referring to FIG. 1, the fastening portion 4 remains uncoated or unencapsulated so that the inlaid part 3, which may be made of sheet metal, can be fastened here so as to abut directly against a fastening flange of a hub of a fan wheel. For fastening, the fastening portion 4 has a hole 5 through which a fastening screw 26 can be fed. Also formed in the fastening portion 4 are alignment recesses 6 into which adapted projections 24 on the fastening flange 22 of the fan hub 21 fit (see FIGS. 5 and 6). The fastening portion 4 is embodied so as to be substantially flat and planar, thus allowing abutment against the corresponding fastening flange over the entire area.

Figure 2:
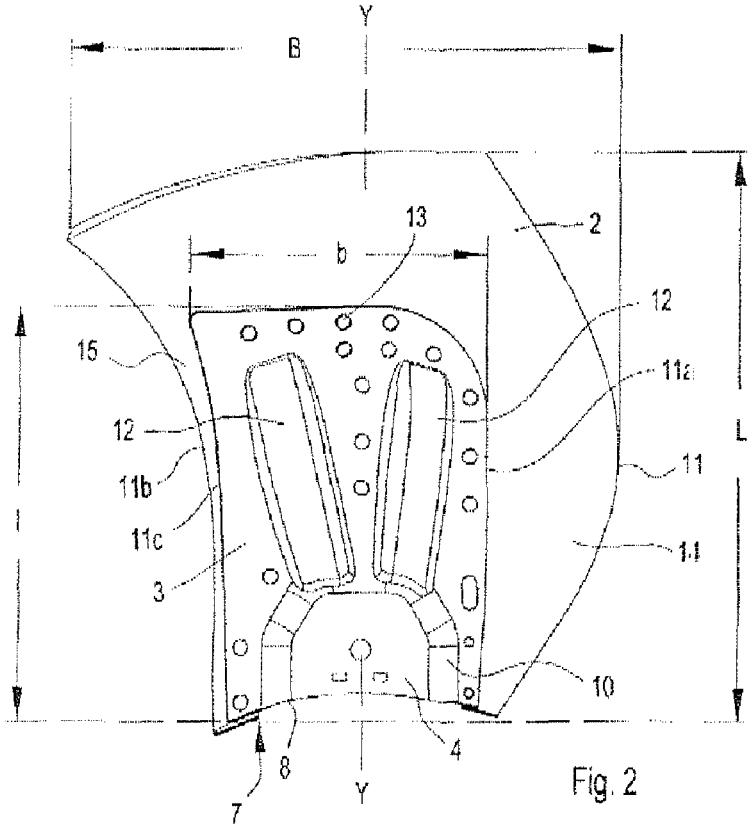
FIG. 2 is another perspective view of the fan blade according to FIG. 1 with removal of the portion of the fan blade encapsulating the inlaid part in order to show the longitudinal section of the inlaid part.
Figure 3:
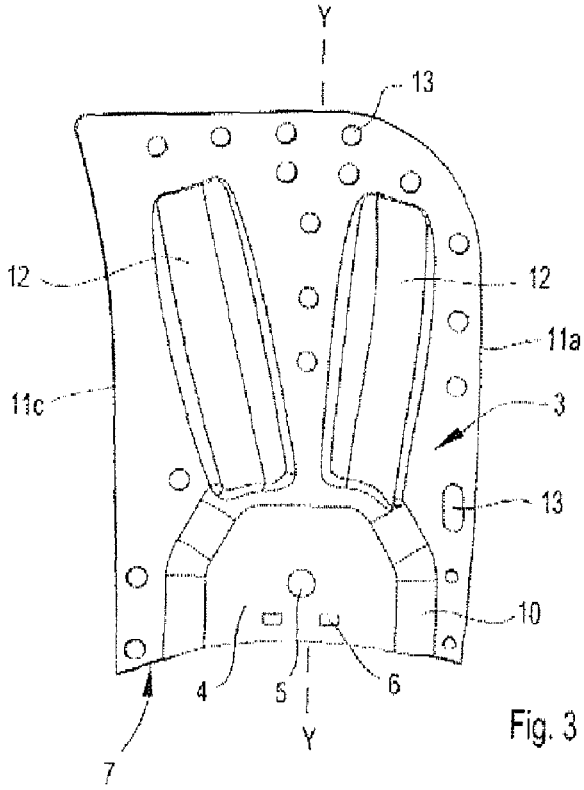
FIG. 3 is an individual view of the inlaid part according to FIG. 2.
Figure 4:
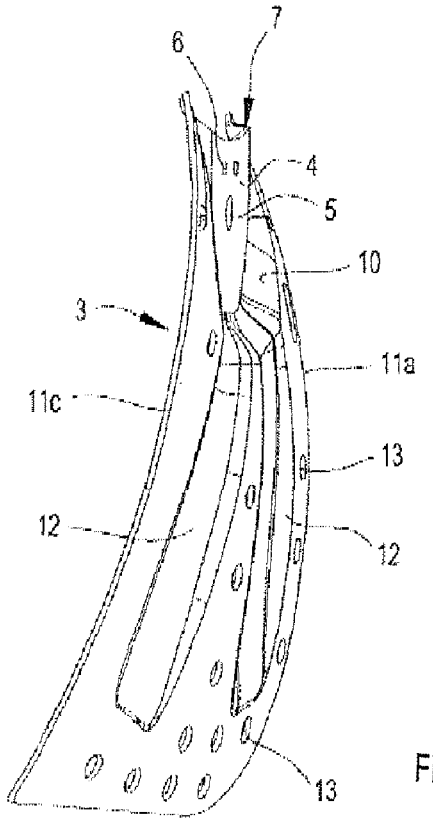
FIG. 4 is a side view of an inlaid part according to the teachings of the present invention.

Referring to FIGS. 1 and 2, the fastening portion 4 is arranged more or less centrally in the fan blade base region 7 and extends directly from the edge 8 of the base region 7 into the blade shaped part 2. The inlaid part 3 should not protrude with its fastening portion 4 beyond the edge 8, but rather is integrated within the blade shaped part 2. Referring now to FIG. 4, the inlaid part 3 is embodied, starting from the fastening portion 4, as an arched shaped part. In this aspect of the present invention, arching is present both in the direction of the longitudinal axis Y-Y and in the direction of the transverse axis X-X. The fan blade according to the teachings of the present invention also has corresponding arching. As the fastening portion 4 is embodied in a flat manner, said fastening portion is comprised by a transition region 10 which is arched in the opposite direction.

FIG. 4 also reveals that the inlaid part 3 may preferably have two stiffening ribs 12. These stiffening ribs 12 run in a spoke-like manner from the circumference of the fastening portion 4 in the direction of the longitudinal extension or of the longitudinal axis Y-Y of the blade body 1 or of the inlaid part 3. These stiffening ribs 12 are impressed into the material of the inlaid part 3. Preferably the inlaid part 3 is made of a steel sheet or an aluminum sheet having a thickness of about 2 mm. It may also be seen from FIG. 4 that the inlaid part 3 has a plurality of apertures 13 which are formed in its surface and can be embodied in a circular or elliptical configuration. The plastics material can pass through these apertures 13 during the sheathing of the blade shaped part 2 with the plastics material (e.g., during insert molding), so that the plastics material is connected to both sides of the inlaid part 3.

The distribution of the apertures 13 is such that the plurality of apertures 13 are arranged between the end of the stiffening ribs 12 and the base portion 7 of the end opposing the blade shaped part 2. The distribution of the apertures 13 may also be in the direction of rotation of the fan blade wheel or of the fan blade in the region between the stiffening ribs 12 and the respective rear longitudinal edge 11 of the fan blade. Thus, the apertures 13 are arranged in such a way and at locations such that they are present in the regions and ensure through-connection of the plastics material where the greatest plastics material overlap is present. Apertures 13 are also formed in the immediate vicinity of the transition portion 10. If the stiffening ribs 12 are also completely enclosed by the plastics material of the blade shaped part 2, a form-fitting and force-transmitting connection is established between the two bodies.

FIG. 2 demonstrates that the shape of the inlaid part 3 and the shape of the blade body 1 are adapted in such a way that the delimiting edges of the blade body 1 and of the inlaid part 3 coincide in the base region 7 and the two opposing delimiting edges in the longitudinal direction Y-Y of the inlaid part 3 and also the corresponding delimiting edges of the blade body 1 run relative to one another in such a way that an extending gap region is present between these edges, starting from the base region 7. In this aspect of the present invention, the gap region 14 is embodied so as to be very much larger in the region (i.e., in the direction of rotation) of the rear delimiting edges 11, 11*a* than the gap region 15 (i.e., in the direction of rotation) of the front longitudinal edges 11*b*, 11*c*. In other words, only a small overlap of the blade shaped part 2 relative to the inlaid part 3 is present in the front region of the blade body, i.e., in the direction of rotation. Preferably, the inlaid part 3 has a maximum length (l) which is about 60% to 85%, preferably approximately 75% to 80% of the maximum length (L) of the blade body 1. Furthermore, the inlaid part 3 has a maximum width (b) that is about 35% to 60%, preferably 38% to 53% of the maximum width (B) of the blade body 1.

One objective of the present invention is to provide an adaptation of the inlaid part 3 and blade shaped part 2 leading to optimum distribution of force within the fan blade, so that changes in length of the fan blade shaped part 2 are avoided.

Figure 5:
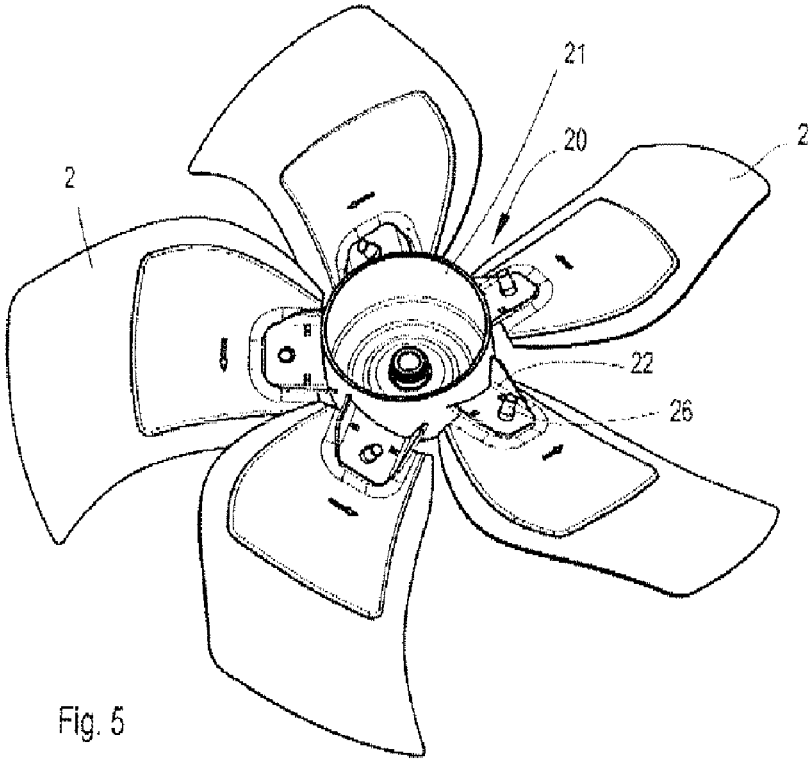
FIG. 5 is a perspective view of a fan wheel according to the teachings of the present invention.
Figure 6:
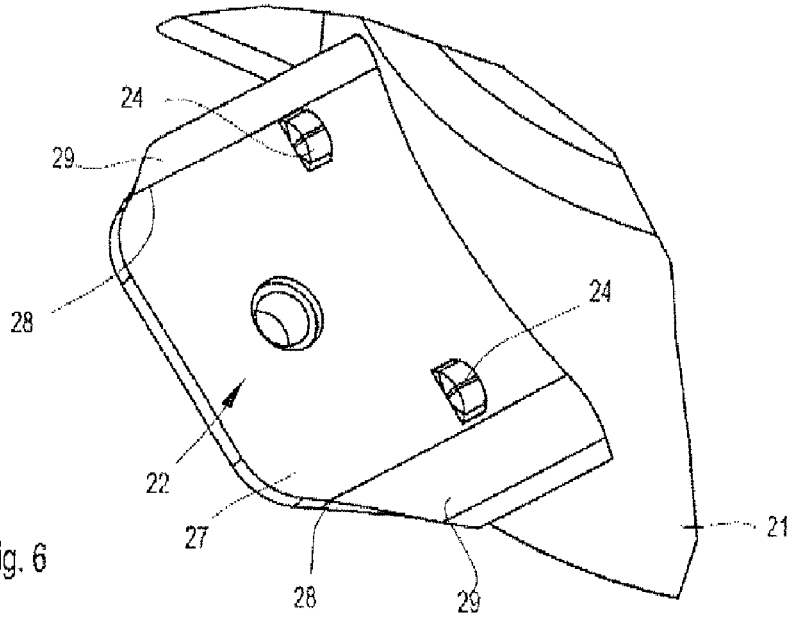
FIG. 6 is an individual view of a fan wheel according to FIG. 5.

A fan wheel 20 according to the invention consists of a hollow cylindrical hub 21 on the circumference of which fastening flanges 22 are positioned. The fan blades according to one aspect of the present invention are fastened to these fastening flanges 22. The hub 21 is preferably made of die cast aluminum or steel and can form the rotor of a DC motor. The fastening portion 4 of the fan blades according to one aspect of the present invention is fastened to the fastening flanges 22. In the case of a die cast aluminum rotor, the fastening flanges 22 can be cast onto the rotor. If, on the other hand, the rotor is, as illustrated in FIGS. 5 and 6, made of steel, then the fastening flanges 22 are welded onto the hub 21 over its circumference. The fastening flanges 22 can be manufactured as punched parts or punched bent parts. Based upon welding-on of the fastening flanges 22, the size and orientation of the blade shaped parts 2 can be varied in any desired manner.

The fastening flanges 22 can be configured as a sheet steel punched bent part comprising a central abutment portion 27 having in each case stiffening webs 29 that are bent over at its longitudinal sides 28. The stiffening webs 29 have a substantially triangular shape; the stiffening webs 29 tapering toward the free end of the abutment portions 27. This produces an embodiment of the fastening flanges 22 that is U-shaped in cross section, preferably in the lower fastening region, where they are welded onto the hub 21.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

The invention claimed is:

1. A fan blade for axial fans with a blade body, the fan blade comprising:

an inner inlaid part having an embedded portion and an unencapsulated fastening portion; and an outer blade shaped part having a fan blade base region;

wherein the outer blade shaped part encases the embedded portion of the inner inlaid part and is made of a lower rigidity material than the inner inlaid part;

wherein the embedded portion of the inner inlaid part has a curved contour corresponding to the shape of the blade body and the unencapsulated fastening portion is flat and positioned proximate to the fan blade base region of the outer blade shaped part.

2. The fan blade as claimed in claim 1, wherein the outer blade shaped part is a plastics material injection-molded part.

3. The fan blade as claimed in claim 1, wherein the unencapsulated fastening portion is arranged more or less centrally in the fan blade base region and extends directly from the edge of the fan blade base region into the outer blade shaped part.

4. The fan blade as claimed in claim 1, wherein curved contour of the embedded portion of the inner inlaid part has, starting from the unencapsulated fastening portion, an arched contour in both a longitudinal direction and a transverse direction of the blade body, and in that the unencapsulated fastening portion is enclosed by a transition region which is arched in the opposite direction thereto, starting from the edge of the fan blade base region.

5. The fan blade as claimed in claim 1, wherein the shape of the embedded portion of the inner inlaid part and the shape of the blade body are adapted to each other in such a way that the delimiting edges of the blade body and of the embedded portion of the inner inlaid part coincide in the base region and the two opposing delimiting edges in the longitudinal direction of the embedded portion of the inner inlaid part and the corresponding delimiting edges of the blade body are adapted to one another in such a way that an extending gap region is formed between these edges, starting from the fan blade base region.

6. The fan blade as claimed in claim 1, wherein the embedded portion of the inner inlaid part has a maximum length (l) which is about 60% to 85%, preferably 75% to 80% of the maximum length (L) of the blade body.

7. The fan blade as claimed in claim 1, wherein the embedded portion of the inner inlaid part has a maximum width (b) which is about 35% to 60%, preferably 38% to 53% of the maximum width (B) of the blade body.

8. The fan blade as claimed in claim 1, wherein the embedded portion of the inner inlaid part has at least one stiffening rib that runs in a spoke-like manner from the circumference of the unencapsulated fastening portion and in the direction of the longitudinal axis (Y-Y) of the blade body.

9. The fan blade as claimed in claim 8, wherein the embedded portion of the inner inlaid part has a plurality of apertures formed in its surface.

10. The fan blade as claimed in claim 9, wherein the plurality of apertures are formed between the end of the stiffening rib and the end of the blade body that is opposite of the fan blade base region and also in the region lying in the direction of rotation of the fan blade and between the stiffening rib and the longitudinal edge, lying in the direction of rotation, of the blade body.

11. A fan wheel, the fan wheel comprising:

a hub;

fastening flanges on the hub; and fan blades having a blade body, the fan blades extending from the hub and fastened to the fastening flanges;

wherein each fan blade comprises a metal part having an inner inlaid part, an unencapsulated fastening portion and an outer blade shaped part having a fan blade base region; the outer blade shaped part partially encasing the inner inlaid part; the inner inlaid part having a curved contour adapted to the shape of the blade body and the unencapsulated fastening portion being positioned centrally to the fan blade base region of the outer blade shaped part.

12. The fan wheel as claimed in claim 11, wherein the fastening flanges are configured as shaped or shaped bent parts that include a flat abutment portion and stiffening webs; which are bent down at the two opposing longitudinal sides of said abutment portion, wherein the abutment portion of the fastening flanges enters into abutment with the unencapsulated fastening portion.

13. The fan wheel as claimed in claim 11, wherein both the hub and the fastening flanges are made of die cast aluminum and are joined together in one piece.

14. The fan wheel as claimed in claim 11, wherein the inner inlaid part is configured to be a metal part; the outer blade shaped part is made of a lower rigidity material than the inner inlaid part; and the fastening flanges are made of steel and are connected to the hub by welding.

15. The fan wheel as claimed in claim 14, wherein the lower rigidity material is a plastics material selected as one from the group of a polyamide plastics material, polypropylene, and polybutylene terephthalate (PBT).

* * * * *